US006683639B2

(12) United States Patent
Driessen-Olde Scheper et al.

(10) Patent No.: US 6,683,639 B2
(45) Date of Patent: Jan. 27, 2004

(54) PRINTHEAD FOR AN IMAGE-FORMING APPARATUS AND AN IMAGE-FORMING APPARATUS CONTAINING THE SAME

(75) Inventors: Lamberdina Driessen-Olde Scheper, Venlo (NL); Catharinus Van Acquoij, Venray (NL); Henrikus G. M. Ramackers, St. Odiliënberg (NL)

(73) Assignee: Oce-Technologies, B.V., Venlo (NL)

( * ) Notice: Subject to any disclaimer, the term of this patent is extended or adjusted under 35 U.S.C. 154(b) by 9 days.

(21) Appl. No.: 10/150,070

(22) Filed: May 20, 2002

(65) Prior Publication Data

US 2003/0007065 A1 Jan. 9, 2003

(30) Foreign Application Priority Data

Jun. 8, 2001 (NL) ..... 1018243

(51) Int. Cl.[7] ..... B41J 2/45; B41J 29/377

(52) U.S. Cl. ..... 347/238; 257/712; 257/713; 372/34

(58) Field of Search ..... 347/238, 207, 347/223; 257/712, 713; 372/34

(56) References Cited

U.S. PATENT DOCUMENTS 4,703,334 A 10/1987 Mochimaru et al.
4,729,061 A 3/1988 Brown
4,831,390 A 5/1989 Deshpande et al.
4,972,205 A 11/1990 Nagato
5,113,232 A 5/1992 Itoh et al.
5,317,344 A 5/1994 Beaman et al.
5,451,989 A 9/1995 Kadowaki et al.
5,486,720 A * 1/1996 Kierse ..... 257/713
6,121,995 A 9/2000 Kattner

FOREIGN PATENT DOCUMENTS

DE 38 22 890 9/1989
WO 01/08891 A1 2/2001

* cited by examiner

*Primary Examiner*—Huan Tran
(74) *Attorney, Agent, or Firm*—Birch, Stewart, Kolasch & Birch, LLP

(57) ABSTRACT

A printhead for an image-forming apparatus, including a substrate, a row of light-emitting elements disposed on a first side of the substrate, and a cooling element disposed on a second side of the substrate opposite to the first side, wherein the substrate is thermally insulating and is provided with at least one thermally conductive track which extends through the substrate from the first side to the second side and is disposed at a predetermined place with respect to the light-emitting elements in order to conduct heat from the first side to the second side in such manner that the elements are kept substantially at a predetermined temperature during operation of the printhead.

9 Claims, 4 Drawing Sheets

PRINTHEAD FOR AN IMAGE-FORMING APPARATUS AND AN IMAGE-FORMING APPARATUS CONTAINING THE SAME

BACKGROUND OF THE INVENTION

The present invention relates to a printhead for an image-forming apparatus, containing a substrate, a row of light-emitting elements disposed on a first side of the substrate, and a cooling element disposed on a second side of the substrate opposite the first side. The present invention also relates to an image-forming apparatus provided with such a printhead.

A printhead and apparatus of this kind are known from U.S. Pat. No. 4,703,334. The known printhead is constructed from a ceramic substrate on which a row (array) of light-emitting diodes (LED's) is disposed. On the first side where the LED's are located, the printhead is also provided with an image-forming element provided with a selfoc lens array. At the back of the substrate, i.e. the second side remote from the LED's, there is a cooling element. The latter is constructed as a support plate made from a material having a high thermal capacity, for example aluminium, so that this element can serve as a heat sink to absorb heat. The cooling element is provided with a number of projecting longitudinal ribs which serve to enable the absorbed heat to be transferred to an air flow taken along the ribs. When the printhead is printing, the LED's produce relatively considerable heat. This heat must be dissipated because the LED temperature must not be too high. A high LED temperature results in a drop in light emission and changes in the wavelength of the emitted light. In addition, the life of the LED's falls off if they are kept at a high temperature. In the known printhead, the heat generated by the LED's is discharged via the thermally conductive ceramic substrate to the cooling element which is in turn cooled by a forced air flow. In this way it is possible to prevent the LED temperature from becoming too high during the operation of the printhead so that the optical image-forming characteristics of the printhead remain constant as far as possible. In addition, the low operating temperature means that the printhead life is also sufficiently long.

A printhead of this kind is also known from German patent 38 22 890. Here again, the printhead is constructed around a thermally conductive substrate, in this case a body made from solid copper. The cooling element is constructed from a large number of rod-shaped elements made from a material having a high thermal capacity and conduction. These rod-shaped elements in turn give up the absorbed heat to an air flow which is conducted along the rod-shaped elements by means of a fan.

The known printheads have a number of significant disadvantages. The thermally conductive substrates required to be able to discharge the relatively considerable quantities of heat to the cooling element are speciality products which are expensive, difficult to obtain and often difficult to machine. For example, it is very difficult using such substrates to make structures having a number of layers and mutual connections. Also, the known materials are often brittle or have little shape stability, which further makes printhead production difficult. All this means that the known printheads are expensive to produce, so that the printhead also has a relatively considerable influence on the total production costs of the image-forming apparatus.

A subsequent disadvantage of the known printheads is that the heat produced by the light-emitting elements is discharged uncontrollably as a result of the very intensive but uncontrollable heat discharge via the conductive substrate. One of the results of this is that the array of light-emitting elements may have too great a spread in temperature and hence also in light yield. For example, if the temperature is locally lower than nominal, so that the light yield there is too high, a visible print artefact may form, such as the disappearance of thin lines. Another disadvantage is that the uncontrolled heat discharge always results in uncertainty concerning the form of the substrate (which is temperature dependent) and hence the print characteristic of the print head. A small deformation can in fact, result in defocusing of an LED so that it is no longer possible to obtain sharp illumination of the photoconductor. This has an adverse effect on print quality.

SUMMARY OF THE INVENTION

The object of the present invention is to provide a printhead which is inexpensive, for example made from relatively standard materials and with relatively standard processes, and with which it is possible to obtain good and controllable cooling of the light-emitting elements. To this end, a printhead has been developed wherein the substrate is thermally insulating and is provided with at least one thermally conductive track which extends through the substrate from the first side to the second side and is disposed at a predetermined location with respect to the light-emitting elements in order to conduct heat from the first side to the second side in such manner that the elements are maintained substantially at a predetermined temperature during operation of the printhead.

According to the present invention, it is possible to use cheap standard materials as the substrate, for example a glass fiber reinforced epoxy plate. A material of this kind is thermally insulating, but this does not mean that overall, no heat can be dissipated by this material, but rather that the coefficient of thermal conduction is so small that when this material is used the temperature of the light-emitting elements might rise to an unacceptably high level if further steps were not taken with respect to cooling. According to the present invention, the provision of one or more thermally conductive tracks through the material at predetermined locations enables sufficient heat to be discharged from the environment of the light-emitting elements to the cooling element. At the same time, a correct choice of the location where these tracks are provided enables the heat dissipation to be accurately controlled. In this way it is possible not only to prevent the temperature of the light-emitting elements from reaching a specific top limit, but also the temperature of the light-emitting elements can be maintained substantially at a predetermined temperature so that adequate uniformity in the temperature is ensured. As a result, the light emission of the elements will also be sufficiently uniform over the length of the array and the substrate will acquire a form known in advance. The predetermined temperature of the light-emitting elements is typically 30–60° C. but, depending on the application, instantaneous load, type of LED's, wear, and so on, can also be outside that range. In addition, this does not have to be a fixed value but can be adjusted in dependence on the above and other factors so that good print quality can be obtained under all conditions.

Thus using a printhead according to the present invention it is possible to obtain an image-forming apparatus with which it is possible to produce images with a very high print quality and wherein the long life of the printhead helps to reduce service costs. In addition, using the printhead according to the present invention enables the printhead costs themselves to have a reduced influence on the total production costs of the image-forming apparatus.

A printhead is also known from U.S. Pat. No. 5,113,232 which is provided with a row of light-emitting elements disposed on a thermally insulating substrate. In this printhead, the heat is discharged via a conductive metal layer disposed over an appreciable part of the surface of the substrate. In this way, the heat produced by the LED's is discharged via lateral transport to a heat sink which in this way acts as a cooling element. A construction of this kind has the significant disadvantage that the heat-dissipating power is relatively small, because the heat has to be transported over a relatively large distance by a thin layer. As a result, the temperature of the LED's can rise to relatively high values. In addition, the substrate itself is heated very non-homogeneously by this construction (only the surface is substantially heated), and this means that during printing the substrate has a considerable risk of becoming deformed due to the occurrence of mechanical stresses in the substrate as a result of an uneven expansion/contraction thereof. A distortion of this kind results in a change of the position of the light-emitting elements, so that the print characteristic of the printhead changes. This takes effect, for example, in a visible deformation of the characters printed with such a printhead. Another disadvantage of this known printhead is that placing further electrical components on the substrate is in conflict with the requirement of adequate lateral heat transport. The electrical connections, in particular, those which are required to actuate these components, cause interruptions in the thermally conductive layer so that the heat dissipation is further limited.

In one embodiment of the printhead according to the present invention, the temperature of the light-emitting elements has a spread over the length of the row such that the light emission over that length has a maximum spread of approximately 15%. By the use of one or more thermally conductive tracks at a predetermined location, heat can be selectively discharged so that a printhead is obtained where the temperature of the light-emitting elements is spread over the row at a sufficiently low value and is also uniform, i.e. lies in an acceptably narrowly limited area. If, for example, a hot spot is systematically present in the row of light-emitting elements, for example because one or more elements are used as outline illumination (which is practically always on), it is possible to discharge more heat locally, for example by the use of a higher concentration of thermally conductive tracks. In this way, a printhead is obtained which has a uniform print characteristic.

In a further embodiment, the row of light-emitting elements is cooled in such a manner that the said temperature has over the length of the row, a spread such that the light emission over that length in turn has a spread of about 10% maximum. This is necessary in environments where an even higher print quality is required, for example in an office environment where a considerable amount of graphic information must be printed. If still higher quality is required, for example if photographs have to be printed, the controlled cooling is preferably such that the temperature difference over the length of the row of light-emitting elements has a spread such that the spread in light emission over that length is about 5% maximum.

In one embodiment of the present invention, the substrate is provided with a thermally conductive layer on the first side, between the light-emitting elements and the substrate. In this embodiment, the heat produced by the row of light-emitting elements is first spread over the substrate in the size of the surface of the thermally conductive layer. This has the advantage that fewer tracks are necessary and the location of the tracks is less critical. In this way, greater degrees of freedom are obtained in the design of the printhead, so that the production costs thereof can be further reduced. In addition, a layer of this kind, if it is also electrically conductive, can serve as a functional electrical contact for the light-emitting elements and possibly other components located on the substrate. It would be possible, for example, to make a layer of this kind in the form of a (semi-)continuous copper film of a specific thickness, typically 35 $\mu$m, which layer can simply be applied with standard processes such as are adequately known from the prior art (e.g. electroplating, chemical deposition, gluing, pressure fixing), and so on. A layer of this kind could also be in the form of a set of partial layers, for example thermally conductive rings around a track or in any other way. The characteristic of a layer of this kind is always that heat is transported laterally in the direction of one or more tracks.

In a further embodiment, the thermally conductive track is disposed laterally of the light-emitting elements. In this embodiment, the track, or a plurality of tracks, is not disposed at the location of the light-emitting elements themselves, i.e. in that part of the substrate above which the light-emitting elements are located, but laterally of said elements. In this embodiment, therefore, the tracks are not covered by the LED chip. It has been found that in this way it is possible to make printheads with a more constant print characteristic. This is probably due to the fact that in the case of optical components the accuracy of positioning is of very great importance. Evidently the tracks result in some irregularity at the surface. If the light-emitting components are then placed at the location of said tracks, this results in inaccuracy in positioning which, in the case of a printhead, can result in visible print artefacts. For non-optical components or optical components not used for forming images, such mis-positioning is irrelevant to the functioning of the components. However, it is of maximum importance for printheads of image-forming apparatus. In this embodiment of the present invention, accurate positioning of the light-emitting elements can be obtained at all times. It has also been found that the provision of the tracks next to the light-emitting elements in turn has a favorable effect on keeping the light-emitting elements at the correct operating temperature, so that the uniformity of the temperature over the row of light-emitting elements, and hence the spread in light emission, can in this embodiment be readily controlled to a functionally adequate level, i.e. the spread in light-emission is sufficiently small.

In one embodiment, the track comprises a hollow cylinder in the substrate, the wall of said cylinder comprising a thermally conductive material. A track of this kind differs from a track in which the conduction takes place through a solid element. A hollow track according to this embodiment can be formed easily by drilling a hole in the substrate, typically with a diameter of 0.1 to 0.6 mm, and providing this hole with a conductive metal layer, for example by electroplating, for example copper in a thickness of typically 10–50 $\mu$m. Tracks of this kind can easily be made with existing techniques, thus further reducing the cost of a printhead according to the invention. Also, as far as the conductive action of the tracks is concerned, it is of little importance what thermally conductive material is used, and it can, for example, be a metal, or alternatively a ceramic or synthetic material, a mixture of materials, for example conductive metal fibers in a substantially insulating filling agent, and so on. An important feature is that the thermally conductive capacity should be within specific operative limits. These limits depend, inter alia, on the type of light-emitting element, the power generated during printing, the configuration of the printhead, the environment (for example the temperature, presence of natural convection, and so on), the number of tracks, and so on.

In one embodiment, in which the substrate comprises on the first side a driver element operatively connected to the said row for actuating the light-emitting elements, the substrate is provided with at least one additional thermally conductive track at the location of the driver element. In this way, heat produced by the driver element can be directly conducted to the cooling element. In this embodiment, at least one driver (driver chip) is located on the substrate next to the light-emitting elements and serves to actuate the light-emitting elements. It can, for example, be a loose chip or alternatively a chip integrated with the chip containing the light-emitting elements. For the driver itself, a uniform and low temperature is of itself of less importance, but since in this embodiment the driver is located on the same substrate it is important that the temperature of this driver also should not be too high or too low and in addition should not differ too much from the temperature of the light-emitting elements. Otherwise, for example, mechanical stresses might form in the substrate and be sufficient to result in distortion of the substrate. As already indicated hereinbefore, such distortion can give rise to print artefacts. Also, an excessive driver temperature can result in heating of the light-emitting elements, and this is undesirable as will be apparent from the foregoing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

In example 1, a number of printheads provided with LED arrays are compared with one another with respect to the cooling of the LED chips.

DETAILED DESCRIPTION OF THE INVENTION

Figure 1:
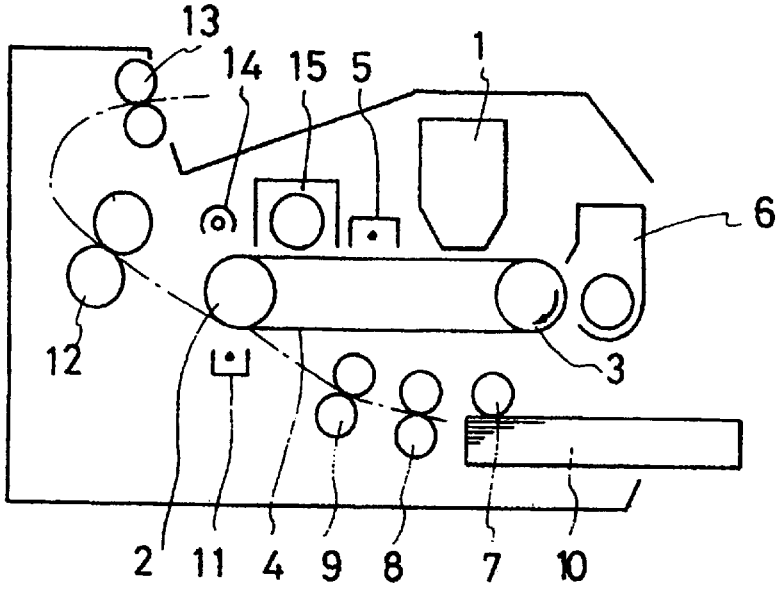
FIG. 1 is a diagram of a printer.

FIG. 1 diagrammatically illustrates a printer. This printer comprises a printhead 1, in this case a page-width row of LED's disposed on a thermally conducting substrate (not shown). The printer is also provided with an endless photosensitive belt 4 trained around the rollers 2 and 3. At least one of these rollers is driven by a motor (not shown) so that the belt rotates in the direction indicated at a substantially constant speed. During this rotation, the outer surface of the belt 4 is uniformly charged by means of a corona 5, which is disposed upstream of the printhead 1. The LED's of the printhead are adapted to be individually actuated by means of a driver circuit (not shown) operatively connected to the LED's. In this embodiment, the driver chips are also situated on the above-mentioned substrate. The driver circuit is actuated image-wise by means of external pulses so that the LED's illuminate the charged photoconductor 4 image-wise. Consequently, the charge on the surface of the photoconductor 4 is selectively dissipated so that an electrostatic latent charge image forms on the photoconductor while it passes the printhead. This charge image is taken along a developing station 6, where the charge image is converted to a visible image, for example by developing the charge image with toner as is adequately known from the prior art.

The toner image is then conveyed to a transfer station where, in this embodiment, a transfer corona 11 is situated. On the other side, a receiving material 10, for example a sheet of paper, is released from a stock pile by means of the separating roller 7. The receiving material is then conveyed by conveyor rollers 8 and 9, which also act as registration rollers, to the transfer station. By correct timing the toner image and receiving material come into registration at the said station. In this station, the toner image is transferred by means of transfer corona 11 from the photoconductor 4 to the receiving material 10. The latter, which now carries the toner image, is then taken through a fixing station 12, where the toner image acquires a permanent adhesion to the receiving material by the application of heat and pressure. The receiving material 10 is then placed in the printer delivery tray by means of the pair of rollers 13. The printer also comprises an after-exposure lamp 14 in order to expose out any residual charge on the photoconductor. The belt 4 is then cleaned in the cleaning station 15, where any residual toner is removed from the surface of the belt 4. The printing process can then re-start for this part of the belt.

Figure 2:
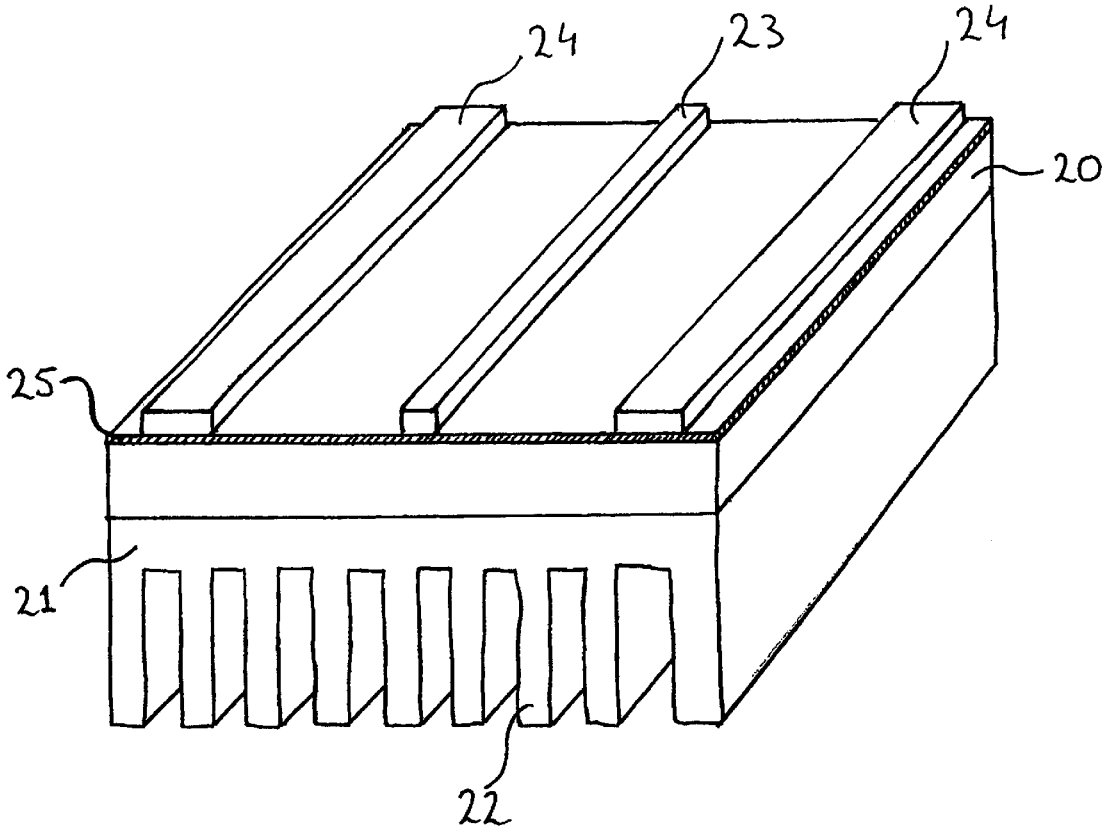
FIG. 2 diagrammatically shows a printhead known from the prior art.

FIG. 2 diagrammatically illustrates a (part of a) printhead. In this example, the printhead comprises a thermally conducting substrate 20 made from a thermally conducting ceramic material (coefficient of thermal conduction approximately 20 W/m ° C.). At the back, the substrate 20 is provided with a cooling element 21, in this case a profiled element constructed from aluminium and provided with fins 22 in order to be able to transmit absorbed heat to the surroundings, in this case by means of a forced air flow (not shown). At the front of this printhead the substrate 20 is provided with a conductive copper layer 25. This acts as a common electrical earth for the components 23 and 24, and an LED array provided with a large number of individual light-emitting diodes and two driver chips. In practice, a printhead, for example a page-width (self-scanning) printhead, can be constructed from a number of such parts, the LED arrays each being situated in extension of one another. When a photoconductor is exposed with a printhead of this kind, considerable heat will be produced at the junctions in the LED array. This heat can readily be dissipated via the copper layer in the substrate, where said heat will be removed by the cooling element 21. In this way the LED's are always cooled to the maximum so that they retain a temperature below a specific top limit. The drivers themselves will also produce heat but the temperature of the drivers is less critical because their functionality depends less on the temperature than in the case of the LED's (which typically emit 1% less light per degree temperature rise). In this printhead, these drivers are also cooled to a maximum by their thermally conductive connection to the cooling element 21 via the copper layer 25 and the substrate 20.

Figure 3:
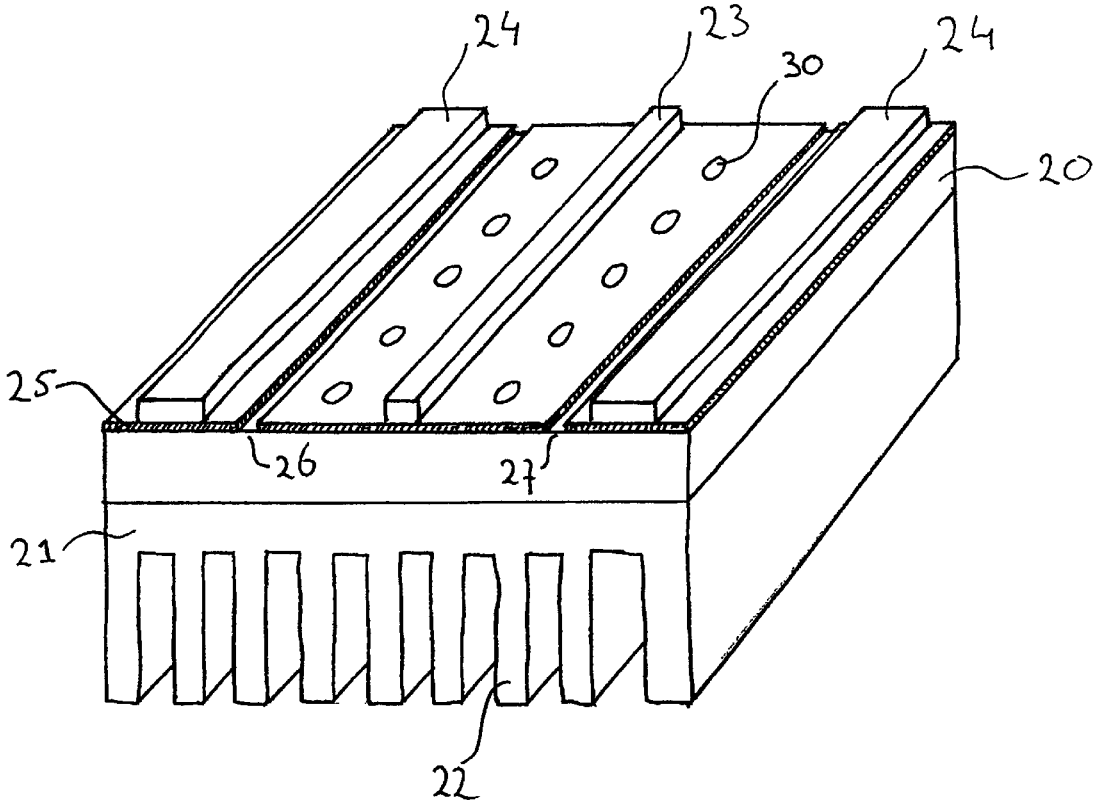
FIG. 3 diagrammatically illustrates a printhead according to the present invention.

FIG. 3 diagrammatically illustrates a printhead according to the present invention. In this example, the printhead comprises a substantially thermally insulating substrate 20 made from a fiber reinforced epoxy resin (coefficient of thermal conduction approximately 0.2 W/m ° C.). At the back, this substrate 20 is provided with a cooling element 21 as described in connection with FIG. 2.

At the front of this printhead, the substrate 20 is also provided with a conductive copper layer 25. This layer 25 also serves as a ground for the LED array 23. In this embodiment, the driver chips 24 are kept at a potential of +5 V via this layer. This is possible because the copper layer is interrupted between the components 23 and 24, as indicated by the reference numbers 26 and 27. As a result of this interruption, the LED array and driver chips are adequately decoupled thermally because the substrate 20 is itself substantially thermally insulating.

In this example the printhead is provided with two rows of conductive tracks 30, each row having five tracks. Each of these tracks extends transversely through the substrate 20, starting at the copper layer 25 and ending at the cooling element 21. In this embodiment, a thermally conductive layer is also provided between the substrate 20 and the cooling element 21, namely a thin copper layer (not shown). This layer improves the thermally conductive contact between the tracks and the cooling element.

Figure 4:
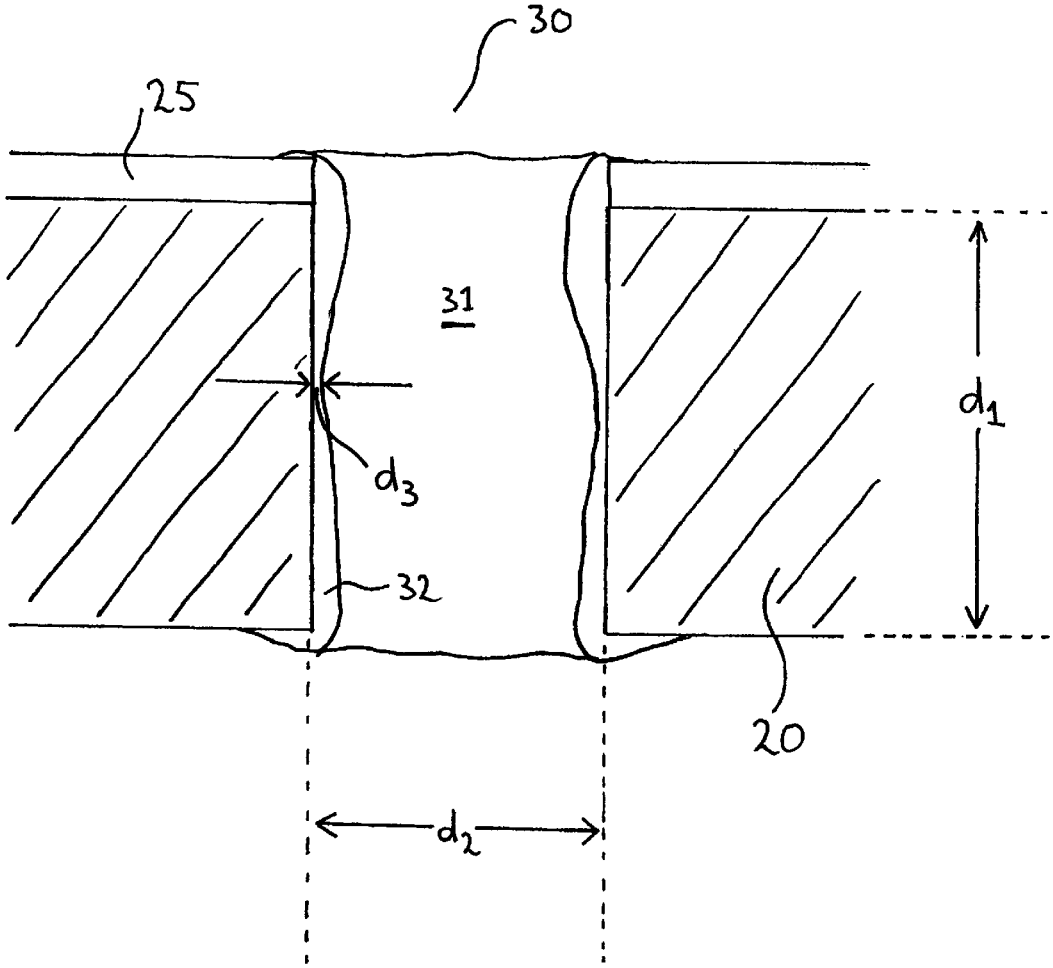
FIG. 4 diagrammatically indicates a thermally conductive track.

FIG. 4 shows in greater detail an example of a conductive track that can be used in a printhead according to this embodiment. The location of the tracks as shown in this example, i.e. a regular and mirror-symmetrical location, is suitable, for example, for a row of light-emitting elements which does not have any systematic hot spots. In this embodiment, the direct surroundings of the two driver chips 24 are not provided with thermally conductive tracks. The driver chips also produce heat that have a higher permissible operating temperature so that in certain cases there is no need for a good thermally conductive contact between the driver chips 24 and the cooling element 20. As soon as it is apparent that the temperature of the drivers in a specific application and/or printhead configuration is in the region of a critical value, each of the driver chips can, for example, be provided with one or more thermally conductive tracks. These can be disposed, for example, directly under a driver chip, i.e. between the driver chip and the substrate, for good heat dissipation.

During writing with a printhead of this kind, the heat produced in the LED array will be moved laterally, via the copper layer, over the substrate surface, at least over the part of the copper layer at the location of the LED array. The heat will then be moved via the thermally conductive tracks 30 through the substrate in the direction of the cooling element 20. Here the heat will be further dissipated as described above in connection with FIG. 2.

By a suitable choice of location of the conductive tracks it is possible for the heat dissipation to the cooling element to be controlled. An optimal heat dissipation such that the printhead combines a functionality suitable for its task with a very long life also depends on other factors which are associated with the construction of the printhead, for example the heat-dissipating power of each of the tracks, the number of tracks, the thickness of the substrate, the cooling power of the cooling element 20, the construction of the printhead, and so on. In this embodiment, for example, using a small number of tracks it is possible to obtain good temperature uniformity over the array because the heat forming in the LED array is not spread over the entire substrate due to the thermal decoupling as a result of the interruption in the copper layer.

Factors associated with the use of the printhead are also important for optimum, i.e. controlled, heat dissipation. Such factors are, for example, the specific application of the printer (for example in a CAD environment or a productive office environment), the printing process (black-writing or white-writing printhead), the surroundings (tropically hot, cold, damp, and so on), the type of LED's (high or low efficiency), the type of drivers, the load on the printhead, and so on. The expert in the area of printheads will find it simple to determine by experiments which configuration gives adequately controlled heat dissipation in a specific case.

FIG. 4 diagrammatically shows an example of a conductive track 30 of the kind that can be used in a printhead according to the present invention. In this example, the substrate is an epoxy sheet of a thickness of d1 equal to 1.0 mm. At the top, the substrate is provided with a copper layer 25 of a thickness of approximately 35 $\mu$m. The substrate is provided with a continuous hole 31 with a diameter d2 of approximately 0.3 mm. The wall of this hole is provided with a thermally conductive layer 32, in this case a copper layer, which is provided by electroplating, which process is adequately known to one skilled in the art. By using this process, a copper layer is often obtained which has a minimum thickness at the middle of the substrate, indicated by d3 in the drawing. Since the thermal transport capacity of the conductive track 30 is determined by this minimum thickness d3, it is a simple manner to adjust this capacity. Depending on the process parameters selected, for example, in applying the thermally conductive layer, the thickness can be adjusted. In one practical embodiment, the thickness d3 is between 20 and 60 $\mu$m.

EXAMPLE 1

In this example, a number of printheads provided with LED arrays are compressed as regards the cooling of the LED chips. Each of the printheads has the basic construction as shown in FIGS. 2 and 3 respectively. In this example, each of the LED and driver chips is approximately 5 mm long, the LED chip being approximately 0.6 mm wide and the driver chips approximately 3 mm wide. The distance between the LED chip and the driver chips is about 2 mm. These components are glued on the substrate by an approximately 15 $\mu$m thick layer of glue. The glue has a coefficient of thermal conduction of about 1.2 W/m ° C. and is thus substantially thermally insulating.

At each of the printheads, a copper layer (coefficient of thermal conduction about 390 W/m ° C.) which serves as a functional electric contact for the components, is applied between the components and the substrate. This layer has a thickness of approximately 35 $\mu$m. In all the printheads the copper layer is interrupted between the LED and driver chips, unless otherwise stated. In every case the LED is a high-efficiency AlGaAs LED selected with a thickness of about 0.35 mm and a coefficient of thermal conduction of approximately 29 W/m ° C. The driver chips are also 0.35 mm thick, are of silicon, and have a coefficient of thermal conduction of about 150 W/m ° C.

In every case, the substrate is approximately 1 mm thick and is either of a thermally conductive ceramic (coefficient of thermal conduction approximately 19 W/m ° C.) or a fiber-reinforced thermally insulating epoxy resin (coefficient of thermal conduction approximately 0.22 W/m ° C.). The cooling element in all these printheads is an aluminium plate which is used as a heat sink, the plate having a thickness of about 2 mm and provided with longitudinal ribs which are cooled via a forced air flow to a temperature of about 34° C.

If, in a printhead according to this example, thermally conductive tracks are provided on the side of the LED chip, these tracks are as shown in FIG. 4, where d3 is approximately 15 $\mu$m. The tracks are always disposed at the side of the LED chip as shown in FIG. 3. The following table always gives the total number of tracks per LED chip. This number is as far as possible distributed proportionally over the two sides of the LED chip (in the case of an odd number of tracks, one track more is disposed on one side than on the other side), the distance between the side of the LED chip and the middle of the track 30 being about 0.6 mm. In some cases, tracks are also used for the driver chips. In those cases, the number of tracks per driver is indicated in the table below. The tracks are always disposed at the location of the drivers (i.e. centrally beneath their surface).

In this example, each of the printheads is used in a fast printer (100 pages per minute). The printhead is always a page-width (about 30 cm) array constructed from 64 LED chips and 128 driver chips. For a given load on the printhead typical for the environment in which a print of this kind is located, and given a specific ageing of both the printhead and the photoconductor, approximately 40 watts of power should be discharged from the front of the printhead. In practice, in dependence on numerous factors, this total required discharge varies typically between 10 and 250 watts. The measurements were carried out at an ambient temperature at the printhead equal to about 34° C.

The following table gives the temperature that the LED's reach at the location of their junction for a number of printheads in the case of a load as described above. The first column gives the number of the printhead and the second column the substrate used in connection with that printhead. Columns 3 and 4 indicate how many tracks there are used per type of chip (LED and driver). Column 5 indicates what the steady temperature is of the LED's at the location of their junction under the above printhead load. This temperature can readily be determined by means of an infrared or other temperature meter. Column 6 indicates the spread in this temperature over the length of the printhead. It will be seen that a 1° C. spread in the temperature of this type of LED corresponds to an approximately 1% spread in light emission of the LED's. Columns 7 and 8 finally give a qualitative indication of the print quality and the cost price of the printheads.

TABLE 1

Average temperature of LED's at location of the junction and temperature uniformity during printing, plus a qualitative indication of print quality and cost price of the printhead, for a number of printheads.

| No | Substrate | Tracks per LED | Tracks per driver | T [° C.] | ΔT [° C.] | Print quality | Cost price |
|---|---|---|---|---|---|---|---|
| 1 | Ceramic | 0 | 0 | 39 | 6 | ++ | −− |
| 2 | Epoxy | 0 | 0 | 106 | 32 | −− | ++ |
| 3 | Epoxy | 10 | 2 | 43 | 5 | ++ | + |
| 4 | Epoxy | 5 | 2 | 46 | 9 | ++ | + |
| 5 | Epoxy | 2 | 2 | 53 | 15 | + | + |
| 6 | Epoxy | 10 | 0 | 44 | 8 | ++ | + |
| 7 | Epoxy, copper running through | 10 | 0 | 48 | 12 | + | + |

Printheads 1 and 2 are comparative examples. Printhead 1 is constructed around a thermally conductive ceramic substrate. The set temperature thus reached at the LED's is good and also the temperature spread over the length of the entire array is small. The print quality and the life of this printhead are therefore very good. However, the cost price of such a printhead is very high. Printhead 2 is constructed around a cheap epoxy substrate which is thermally insulating. The average temperature of the LED's is accordingly very high so that the life of a printhead of this kind is short. In addition, the spread over the entire LED array is very considerable, and this has a very adverse effect on print quality since the spread in light emission is, as a result, unacceptably high.

The printheads 3–7 are printheads according to the present invention. It will be clear that the number of tracks influences the final temperature of the LED's and the spread thereon. Depending on the required life of the printhead and the print quality required, the it can be determined by a number of simple experiments what the optimal configuration is for a specific situation. The cost price of the printhead according to the present invention is favorable in every case. A large number of tracks generally results in a (slight) increase in cost price.

In all the printheads according to the present invention the driver temperature is about 50° C. Only at printhead 6 is this temperature approximately 80° C., but this is always sufficiently low to guarantee good functionality. The reason for this higher temperature is the absence of tracks for the drivers and the thermal decoupling between the LED chip and the driver chips due to the interruption of the conductive copper layer between the components and the substrate. In the case of printhead 7, the tracks are also absent for the drivers, but the copper layer is not interrupted. As a result, the LED and driver chip are thermally coupled and the driver chips assume practically the same temperature as the LED chip, namely about 48° C.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printhead for an image-forming apparatus, comprising a substrate, a row of light-emitting elements disposed on a first side of the substrate, and a cooling element disposed on a second side of the substrate opposite to the first side, wherein the substrate is thermally insulating and is provided with at least one thermally conductive track which extends through the substrate from the first side to the second side and is disposed at a predetermined location with respect to the light-emitting elements in order to conduct heat from the first side to the second side in such manner that the elements are maintained substantially at a predetermined temperature during the operation of the printhead.

2. The printhead according to claim 1, wherein the temperature over the length of the row has a spread such that the light emission over said length has a maximum spread of about 15%.

3. The printhead according to claim 2, wherein the temperature over the length of the row has a spread such that the light emission over said length has a maximum spread of about 10%.

4. The printhead according to claim 3, wherein the temperature over the length of the row has a spread such that the light emission over said length has a maximum spread of about 5%.

5. The printhead according to claim 1, wherein the substrate is provided with a thermally conductive layer on the first side between the light-emitting elements and the substrates.

6. The printhead according to claim 1, wherein the thermally conductive track is disposed laterally of the light-emitting elements.

7. The printhead according to claim 1, wherein the track comprises a hollow cylinder in the substrate, the wall of said cylinder comprising a thermally conductive material.

8. The printhead according to claim 1, wherein the substrate comprises a driver element on the first side, said driver element being operatively connected to the said row for actuating the light-emitting elements, wherein the substrate is provided with at least one additional thermally conducting track at the location of the driver element.

9. An image-forming apparatus provided with the printhead of claim 1.

* * * * *